United States Patent [19]

Gaston et al.

[11] Patent Number: 4,557,030

[45] Date of Patent: Dec. 10, 1985

[54] MULTIPURPOSE APPARATUS AND METHOD FOR TUNING AND GROOVING A SKI

[76] Inventors: John C. Gaston; Richard K. Fairall, both of 2640 N. 54th Pl., Phoenix, Ariz. 85008

[21] Appl. No.: 618,087

[22] Filed: Jun. 7, 1984

[51] Int. Cl.[4] ..... B21K 21/00

[52] U.S. Cl. ..... 29/402.06; 76/83; 7/158; 30/172; 51/204; 51/181 R

[58] Field of Search ..... 30/172, 287; 51/181 R, 51/205 WG, 204; 76/82, 83, 88; 7/158; 29/402.06, 402.03, 402.04, 402.05

[56] References Cited

U.S. PATENT DOCUMENTS

| | | | |
|---|---|---|---|
| 3,643,328 | 2/1972 | Wainwright, Jr. | 30/172 |
| 3,875,825 | 4/1975 | Buttofuoco | 76/88 X |
| 3,934,287 | 1/1976 | Howard | 7/158 |
| 4,060,013 | 11/1977 | Thompson . | |
| 4,089,076 | 5/1978 | Sparling | 76/83 X |
| 4,121,484 | 10/1978 | Gorlach et al. | 76/83 |
| 4,189,874 | 2/1980 | Labriola | 76/83 X |
| 4,280,378 | 7/1981 | Levine | 76/83 |
| 4,442,636 | 4/1984 | Obland | 76/83 X |

*Primary Examiner*—Howard N. Goldberg
*Assistant Examiner*—Carl J. Arbes
*Attorney, Agent, or Firm*—Weiss & Holloway

[57] ABSTRACT

A multipurpose ski apparatus is presented which may be used to tune and groove a ski. The apparatus may be easily held by a person's hand. It has a file on its upper end for filing the bottom side of a ski, a metal scraper for scraping the bottom of the ski, two rotating blades coupled to its bottom surface for filing the sides of the ski, and a removable insert which may be placed into an aperture in the bottom surface for grooving a layer of wax applied to the bottom surface of the ski. The multipurpose ski apparatus may be used without a vise or any other anchoring device. A method for tuning a ski with the multipurpose apparatus is also presented which comprises the steps of scraping the wax off the bottom surface of the ski by the metal scraper, filing the bottom surface of the ski with the file fastened to the top end of the apparatus, and simultaneously filing the sides of the ski with the two rotating files. If the ski is to be grooved, then a method of both tuning and grooving a ski is presented which includes the above-described steps in addition to the steps of applying a layer of wax onto the bottom surface of the ski, placing a groove in the wax along the centerline of the ski with a removable insert which may be placed into the bottom surface of the apparatus, and scraping off any excess wax with the metal scraper.

17 Claims, 12 Drawing Figures

MULTIPURPOSE APPARATUS AND METHOD FOR TUNING AND GROOVING A SKI

BACKGROUND OF THE INVENTION

The present invention relates generally to the apparatus and method used for tuning and grooving skis and, more particularly, to a multipurpose apparatus and method which may be used to tune a ski and place a longitudinal groove in a layer of wax applied to the bottom of the ski.

Ski tuning can be a difficult and time consuming chore. Typically, a number of tools are needed to properly tune a pair of skis. The required tools are often sold in a kit and may include files, an edge sharpener, a scraper, etc. A ski vise is also necessary to hold the ski while it is being tuned.

Before a ski is tuned, old wax is scraped off the bottom of the ski to prevent the wax from being embedded in any files used during tuning. This requires some type of scraping tool. During the tuning procedure, a hand file is typically used to file or smooth out the bottom of the ski. Hand filing of the bottom of a ski is a laborous task and a person must be careful not to hold the file by its ends in order to prevent it from bending or flexing. Filing the sides or edges of a ski is a difficult task because the ski must be placed on it's side in a vise and the file must be held perpendicular to the bottom of the ski while taking great care to keep the file flat against the edges. This is usually accomplished by keeping both thumbs on top of the file with the index fingers under it to stabilize and guide it.

Wax is usually applied to the bottom of the ski after tuning. This may be accomplished by an apparatus which directly applies the wax to the ski or, more typically, by dripping wax from a special type of candle onto the ski and then smoothing the wax by a hot iron. In order to improve the performance of skis, often a longitudinal groove is cut into the layer of wax along the centerline of each ski. This is typically done by a hand tool or coin which are hard to use because it is difficult to properly align the groove along the centerline of the ski.

Accordingly, there is a need for a single portable, multipurpose apparatus and method which may be used to both tune a ski and place a longitudinal groove in the layer of wax applied to the bottom of the ski. Such an apparatus and method are needed in order to minimize the difficulty usually involved in tuning a ski and grooving the wax on the bottom of the ski.

SUMMARY OF THE INVENTION

It is an object of this invention to provide an improved multipurpose apparatus for tuning and grooving a ski.

It is another object of the invention to provide an improved multipurpose apparatus with built-in features which may be used to both tune a ski and groove the layer of wax applied to the bottom of the ski.

It is a further object of this invention to provide an improved multipurpose apparatus with built-in features which minimizes the difficulty usually involved in tuning and grooving a ski.

It is still a further object of this invention to provide an improved method of tuning a ski.

It is still a further object of this invention to provide an improved method of both tuning and grooving a ski.

In accordance with one embodiment of this invention, a multipurpose ski apparatus is disclosed which comprises a gripping body; first filing means fastened to the gripping body for filing the bottom of a ski; scraping means operably attached to the gripping body for scraping wax and other material off the ski; and second filing means rotatably coupled to the gripping body for filing the sides of the ski. In this embodiment, an apparatus which may be easily held by a person's hand has a file fastened to its top end for filing the bottom surface of a ski, a stainless steel strip attached to its lower end for scraping the bottom surface of the ski, and two rotating files coupled to its bottom surface for filing the sides of the ski. In addition, two stainless steel strips are fastened to the bottom surface of the apparatus in order to reduce wear. A removable insert may be placed into an aperture in the bottom surface of the apparatus for placing a groove in the wax applied to the bottom surface of the ski along the centerline of the ski. It is important to note that the apparatus can be used without a vise or any other anchoring device.

A method of tuning a ski with the multipurpose apparatus is disclosed which comprises the steps of scraping the wax off the bottom surface of the ski by the metal scraper, filing the bottom surface of the ski with the file fastened to the top end of the apparatus, and simultaneously filing the sides of the ski with the two rotating files. If the ski is to be grooved, then a method of both tuning and grooving a ski is disclosed which includes the above described steps in addition to the steps of applying a layer of wax onto the bottom surface of the ski, placing a groove in the wax along the centerline of the ski with a removable insert which may be placed into the bottom surface of the apparatus, and scraping off any excess wax with the metal scraper.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENT

Figure 1:
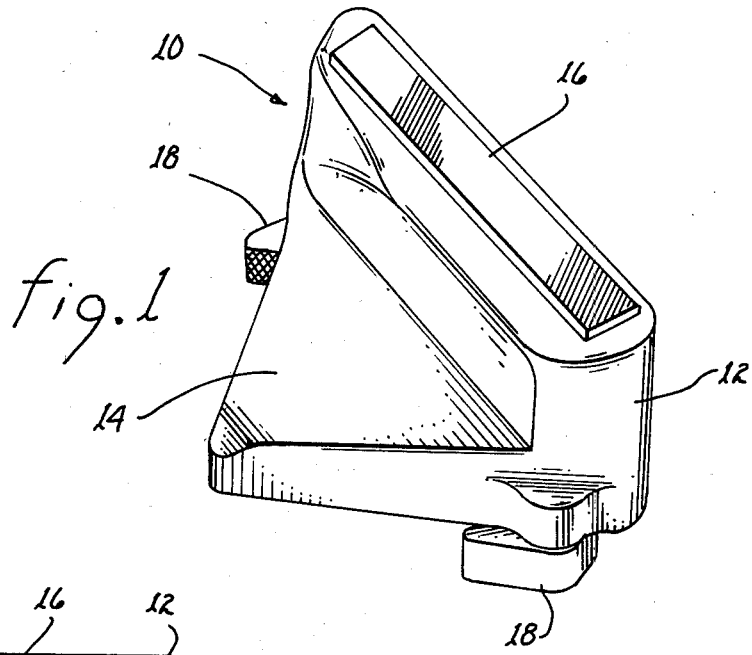
FIG. 1 is a perspective view of a multipurpose apparatus with built-in features.
Figure 2:
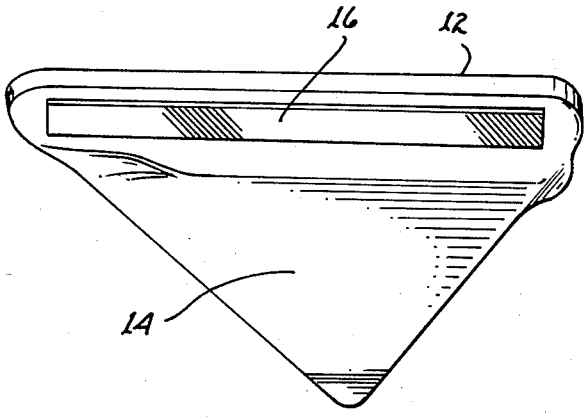
FIG. 2 is a top plan view of the multipurpose apparatus.
Figure 3:
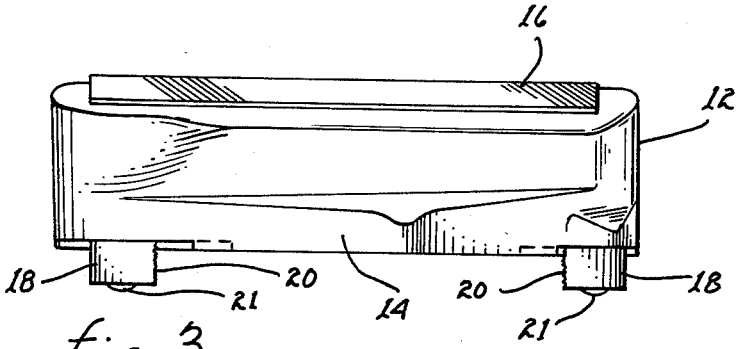
FIG. 3 is a front elevational view of the multipurpose apparatus.
Figure 5:
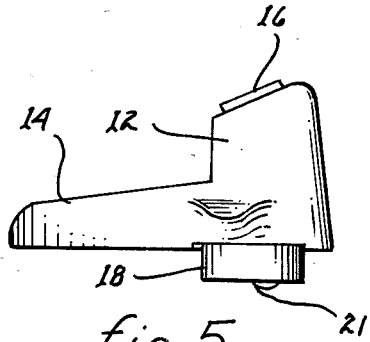
FIG. 5 is a side elevational view of the multipurpose apparatus.

FIG. 1 shows a perspective view of a multipurpose apparatus, generally designated by reference number 10, which may be used for tuning a ski. The multipurpose apparatus 10 consists of an elongated portion 12 having a generally rectangular-shaped cross section and a cantilevered portion 14 having a generally triangular-shaped outside configuration. The cantilevered portion 14 is rigidly fastened to the bottom end of the elongated portion 12. The multipurpose apparatus 10 is preferably fabricated with an elongated portion 12 and cantilevered portion 14 so that it may be easily grasped by a person's hand. However, the shape of the apparatus 10 may be varied if desired. The multipurpose apparatus 10 is preferably made out of a lightweight material such as plastic, a plastic-glass alloy, or the like. The apparatus 10 may be solid or preferably hollow. If it is hollow, then it will have a shell-type structure (not shown) more conducive to a lightweight design. A bottom file 16 is rigidly fastened to the top end of the elongated portion 12. Two rotating files 18 are rotatably coupled to the bottom of the multipurpose apparatus 10. FIGS. 2, 3, and 5 show top, front, and side views of the multipurpose apparatus 10. Note that the rotating files 18 have edge files 20. The rotating files 18 are rotatably coupled to the apparatus 10 by a fastening device 21 which may be a screw, or the like.

Figure 4:
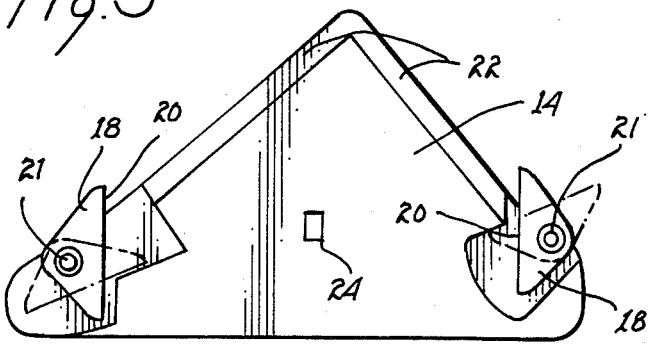
FIG. 4 is a bottom plan view of the multipurpose apparatus.

Referring to FIG. 4, metal guards 22 are shown fastened to the bottom of the apparatus 10. The metal guards 22 are preferably made out of stainless steel and protect the bottom of the apparatus 10 from excessive wear. An aperture 24 passes through the bottom of apparatus 10 to a depth required for engaging a removable insert or groover 30 (see FIG. 12). If a hollow, shell-type structure is used for the apparatus 10, the aperture 24 may pass through the thickness of the shell and may comprise a circular hole with two elongated slots (not shown). In addition, a door (not shown) preferably with hinges may be attached to the bottom of the shell-type structure to allow different size groovers 30 to be stored inside the apparatus 10. It is important to note that the rotating files 18 are free to rotate as indicated by the dotted lines shown in FIG. 4.

Figure 6:
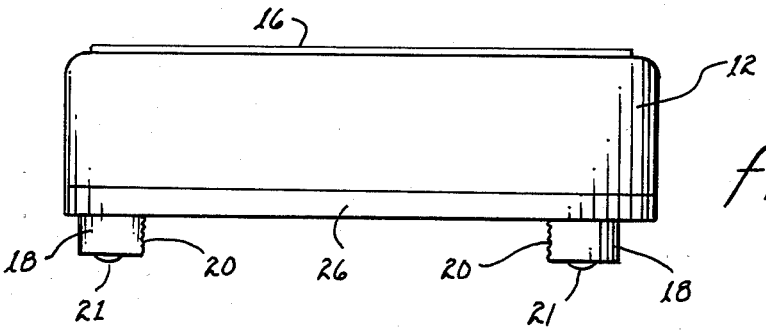
FIG. 6 is a rear elevational view of the multipurpose apparatus.
Figure 7:
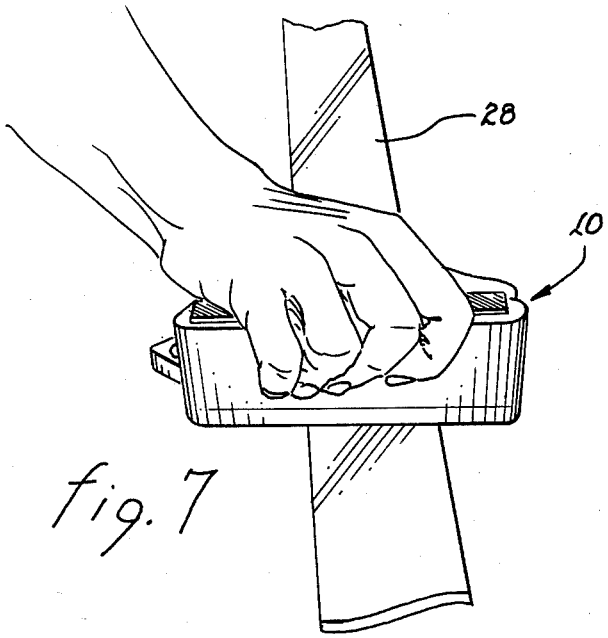
FIG. 7 is a perspective view of the multipurpose apparatus showing how the apparatus may be used to scrape wax off the bottom of the ski.

A metal scraper 26 is shown in FIG. 6 fastened to the rear of the multipurpose apparatus 10. The metal scraper 26 is used for scraping wax off the bottom of a ski 28 as illustrated in FIG. 7. Old wax must be scraped off the bottom of the ski 28 before it can be tuned. The metal scraper 26 should extend slightly below the bottom surface of the apparatus 10 so that it will be in direct contact with the wax during the scraping step. The scraper 26 is preferably made out of stainless steel, or the like.

Figure 9:
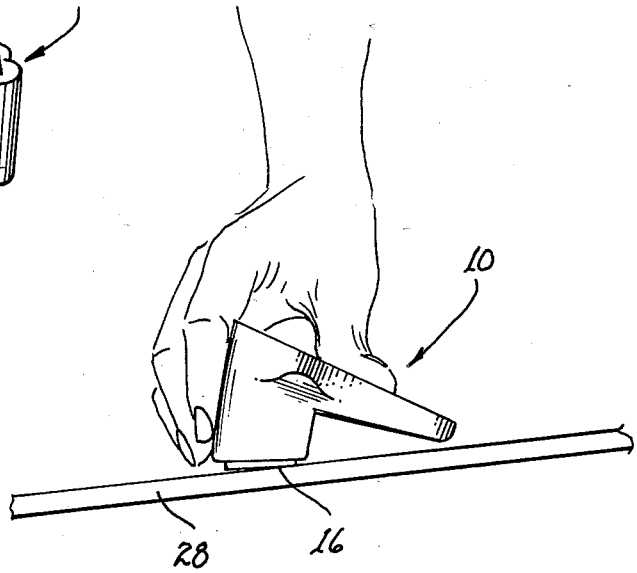
FIG. 9 is a side view of the multipurpose apparatus showing how the apparatus may be used to file the bottom of a ski.
Figure 8:
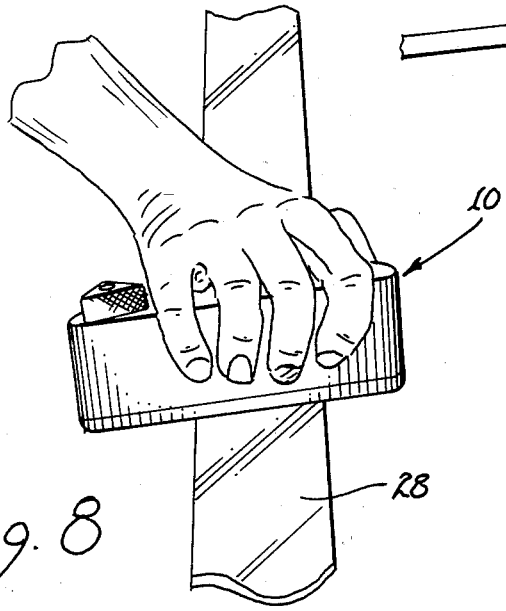
FIG. 8 is a perspective view of the multipurpose apparatus showing how the apparatus may be used to file the bottom of a ski.

After the wax is scraped off the ski 28, the multipurpose apparatus 10 is turned over and the bottom of the ski 28 is filed by the bottom file 16 as shown in FIGS. 8 and 9. This step removes any indentations that may be in the bottom of the ski 28 and should leave a generally smooth surface. Since the bottom file 16 is fastened to the apparatus 10, it will not bend or flex during this step. Note how the apparatus 10 may be easily grasped by a person's hand.

Figure 10:
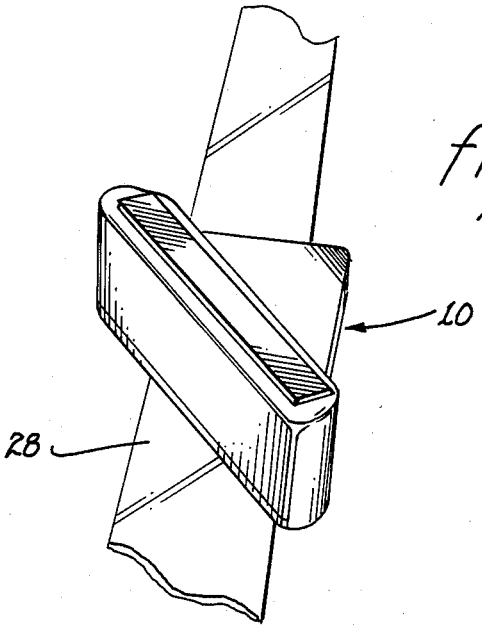
FIG. 10 is a top perspective view of the multipurpose apparatus showing how the apparatus may be used to file the edges of the ski.
Figure 11:
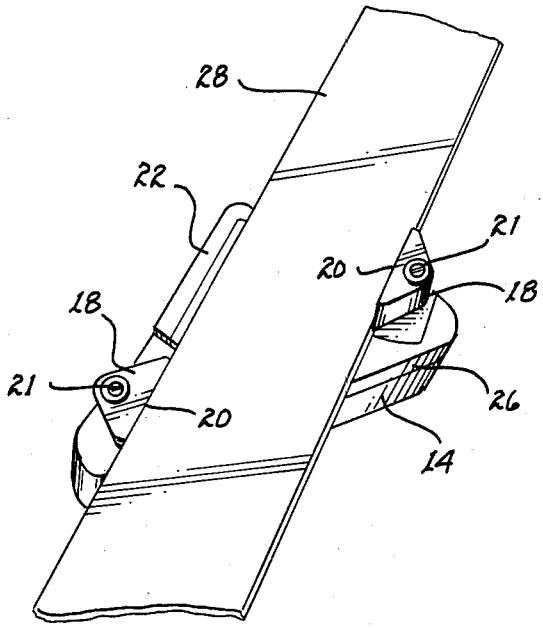
FIG. 11 is a bottom perspective view of the multipurpose apparatus showing how the rotating files engage the edges of the ski.

FIGS. 10 and 11 illustrate how the edges or sides of the ski 28 are filed. The apparatus 10 is simply placed on top of the ski 28 and rotated until the edge files 20 come into contact with the edges of the ski 28. The edge files 20 will be kept flat against the edges because the faces of the files 20 are perpendicular to both the bottom of the ski 28 and the bottom of the apparatus 10 (see FIG. 12). During this step, both edges are simultaneously filed by moving the apparatus 10 along the length of the ski 28 and rotating the apparatus 10 sufficiently to keep the files 20 biased against the edges. Since the rotation of the apparatus 10 can be varied to keep the files 20 in contact with the edges of the ski 28, and width ski 28 can be tuned by the apparatus 10.

Figure 12:
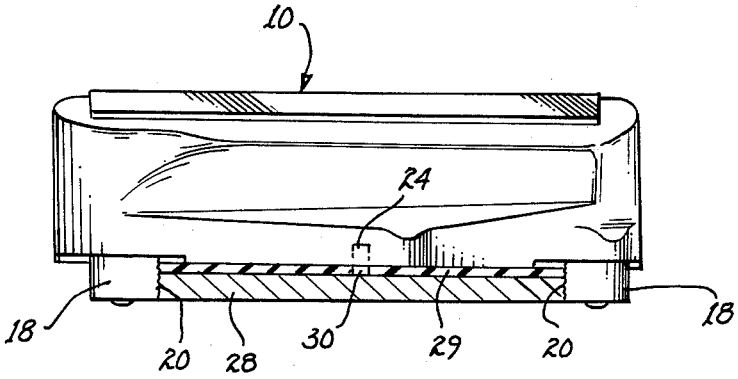
FIG. 12 is a front elevational view of the multipurpose apparatus with a cross-sectional view of the ski showing how a groover is used to cut a longitudinal groove in a layer of wax applied to the bottom of the ski.

After the bottom and edges of the ski 28 have been filed, a layer of wax 29 may be applied to the bottom of the ski 28 as illustrated in FIG. 12. The apparatus 10 may then be used to scrape any excess wax off the ski 28. This may be accomplished using the apparatus 10 as shown in FIG. 7. After the excess wax is removed, a removable insert or groover 30 is inserted into the aperture 24 in the bottom of the apparatus 10. The apparatus 10 is then placed on top of the ski 28 and rotated to bring the edge files 20 into contact with the edges of the ski 28 (see FIGS. 10 and 11). This positions the groover 30 at the centerline of the ski 28. The apparatus 10 is then moved along the length of the ski 28 which causes the groover 30 to cut or place a groove in the wax along the centerline of the ski 28. After the ski 28 is grooved, any excess wax may be scraped off it if desired by following the scraping step described above.

It is important to note that the apparatus 10 can be used without a vise or any other anchoring device. The ski 28 may be placed on a table or on top of a person's legs who is sitting in a chair and held with one hand while the other hand uses the apparatus 10.

While the invention has been particularly shown and described in reference to preferred embodiments thereof, it will be understood by those skilled in the art that changes in the form and details may be made therein without departing from the spirit and scope of the invention.

We claim:

1. A multipurpose ski apparatus, comprising:
   - a gripping body;
   - first filing means fastened to said gripping body for filing the bottom of a ski;
   - scraping means operably attached to said gripping body for scraping wax and other material off said ski; and
   - second filing means rotatably coupled to said gripping body for filing the sides of said ski.

2. The multipurpose ski apparatus of claim 1, further comprising grooving means removably coupled to said gripping body for placing a groove in a layer of wax applied to the bottom of said ski.

3. The multipurpose ski apparatus of claim 1, wherein said gripping body comprises an elongated portion having a generally rectangular-shaped cross-section and a cantilevered portion having a generally triangular-shaped outside configuration, said cantilevered portion being rigidly fastened to the bottom of said elongated portion.

4. The multipurpose ski apparatus of claim 1, wherein said first filing means comprises a file rigidly fastened to said gripping body.

5. The multipurpose ski apparatus of claim 1, wherein said scraping means comprises a strip of metal attached to said gripping body.

6. The multipurpose ski apparatus of claim 1, wherein said second filing means comprises two files rotatably coupled to said gripping body.

7. The multipurpose ski apparatus of claim 2, wherein said grooving means comprises a removable insert removably coupled to said gripping body.

8. The multipurpose ski apparatus of claim 3, wherein the bottom surfaces of said cantilevered portion and said elongated portion being fastened together to form one continuous bottom surface, said continuous bottom surface having metal strips attached to it in order to protect it from excessive wear.

9. The multipurpose ski apparatus of claim 8, wherein said first filing means comprises a file rigidly fastened to the top of said elongated portion.

10. The multipurpose ski apparatus of claim 9, wherein said scraping means comprises a strip of metal attached to the bottom of said elongated portion, said strip of metal extending below said continuous bottom surface.

11. The multipurpose ski appartatus of claim 10, wherein said second filing means comprises two files rotatably coupled to said continuous bottom surface, said files being simultaneously biased against said sides of said ski due to the rotation of said gripping body.

12. The multipurpose ski apparatus of claim 11, wherein said continuous bottom surface having an aperture therein.

13. The multipurpose ski apparatus of claim 12, further comprising grooving means removably coupled to said gripping body for placing a groove in a layer of wax applied to the bottom of said ski.

14. The multipurpose ski apparatus of claim 13, wherein said grooving means comprises a removable insert removably inserted into said aperture in said continuous bottom surface.

15. A method of preparing a ski, comprising the steps of:

scraping the wax off the bottom surface of said ski by a metal scraper fastened to an apparatus;

after scraping said ski, filing said bottom surface with a file fastened to said apparatus; and subsequent to filing said bottom surface, simultaneously filing the sides of said ski with two files rotatably coupled to said apparatus.

16. The method of claim 15, further comprising the steps of:

applying a layer of wax onto said bottom surface after filing said sides;

scraping excess wax off said bottom surface with said metal scraper; and grooving said layer of wax along the center line of said ski with a removable insert inserted in said apparatus.

17. The method of claim 16, further comprising the step of scraping off excess wax with said metal scraper which was left on said bottom surface after grooving said layer of wax.

* * * * *